US005142986A

United States Patent [19]

Gundel

[11] Patent Number: 5,142,986

[45] Date of Patent: Sep. 1, 1992

[54] MINE, PARTICULARLY AN ANTI-TANK MINE

[75] Inventor: Bernd Gundel, Neuhaus, Fed. Rep. of Germany

[73] Assignee: Diehl GmbH & Co., Nuremberg, Fed. Rep. of Germany

[21] Appl. No.: 722,341

[22] Filed: Jun. 27, 1991

[30] Foreign Application Priority Data

Jul. 20, 1990 [DE] Fed. Rep. of Germany ..... 4023069

[51] Int. Cl.[5] ..... F42B 23/04

[52] U.S. Cl. ..... 102/401; 102/425; 102/427

[58] Field of Search ..... 102/401, 425, 424, 427, 102/393, 409

[56] References Cited

U.S. PATENT DOCUMENTS

| | | | |
|---|---|---|---|
| 4,398,466 | 8/1983 | Sepp et al. | 102/427 |
| 4,848,236 | 7/1989 | Hembise | 102/427 |
| 4,860,658 | 8/1989 | Lindstadt et al. | 102/427 |
| 4,870,904 | 10/1989 | Picot | 102/387 |

FOREIGN PATENT DOCUMENTS

| | | | |
|---|---|---|---|
| 0273787 | 6/1988 | European Pat. Off. . | |
| 0048810 | 10/1988 | European Pat. Off. | 102/401 |
| 3019783 | 2/1982 | Fed. Rep. of Germany . | |
| 3121413 | 12/1982 | Fed. Rep. of Germany . | |
| 3509281 | 9/1986 | Fed. Rep. of Germany | 102/401 |
| 3515497 | 10/1986 | Fed. Rep. of Germany . | |
| 3517826 | 1/1987 | Fed. Rep. of Germany . | |
| 3720672 | 1/1989 | Fed. Rep. of Germany . | |
| 3543769 | 5/1990 | Fed. Rep. of Germany . | |
| 3837483 | 5/1990 | Fed. Rep. of Germany . | |
| 3936065 | 6/1990 | Fed. Rep. of Germany . | |
| 3911115 | 10/1990 | Fed. Rep. of Germany . | |
| 2174482 | 10/1988 | United Kingdom . | |

OTHER PUBLICATIONS

Geor Stammel, *Sperren erganzen Feuer und Bewegung;* wt/8/88, 1988, pp. 74–79.

*Primary Examiner*—David H. Brown
*Attorney, Agent, or Firm*—Scully, Scott, Murphy & Presser

[57] ABSTRACT

A mine, particularly an anti-tank mine, including a warhead which is arranged in a launching installation, and the latter of which is equipped with an aiming device. The mine is equipped with a range-finding device for the determination of the direction and for the measurement of the at least approximately horizontal distance between the mine which is in a lurking position and the target which is to be attacked, especially such as a tank or armored vehicle, and wherein the range-finding device is operatively connected with the aiming device for the setting of a specified launch angle or elevation for the launching installation for the warhead.

6 Claims, 1 Drawing Sheet

MINE, PARTICULARLY AN ANTI-TANK MINE

BACKGROUND OF THE INVENTION

1. Field of the Invention

The present invention relates to a mine, particularly an anti-tank mine, including a warhead which is arranged in a launching installation, and the latter of which is equipped with an aiming device.

2. Discussion of the Prior Art

A mine of the type referred to hereinabove is essentially known from the disclosure of British Patent 2,174,482, commonly assigned to the assignee of the present application. In this disclosed mine, the measures employed for the detection of a target which is to be attacked, especially such as an enemy armored vehicle which is to be attacked, are arranged within the warhead. In that particular case, the launching device is intended to be utilized only as a deploying medium or; in essence, as a transport medium and for storage purposes. Hereby, as a consequence of the detection of the target being implemented from the warhead, it is necessary that the warhead, subsequent to the activation of a launching installation through the intermediary of which the warhead is accelerated out of the launching installation, will carry out a descending movement over a correspondingly lengthy period of time, in order to be capable of detecting the target which is to be attacked. However, this is subject to the inherent danger that the warhead will be recognized and counter-attacked by the target which is to be attacked.

SUMMARY OF THE INVENTION

Accordingly, it is an object of the present invention to provide a mine of the above-mentioned type which, with a comparatively simple construction, possesses a good targeting accuracy, whereby it is possible to attain the defense over a relatively wide corridor of a terrain, as well as an optimum placement of the warhead on the target which is to be attacked.

The foregoing object is achieved for a mine of the above-mentioned type in that the mine is equipped with a distance-measurement or range-finding device for the determination of the direction and for the measurement of the at least approximately horizontal distance between the mine which is in a lurking position and the target which is to be attacked, especially such as a tank or armored vehicle, and wherein the range-finding device is operatively connected with the aiming device for the setting of a specified launch angle for the launching installation for the warhead.

With respect to the inventive mine, the launch of the warhead is not carried out in a substantially quasi-blind condition in an at least approximately vertical direction, but rather is correctly or fittingly oriented against the target which is to be attacked, as a result of which, in an advantageous manner, it is possible that the warhead, in view of an optimized steep angle of attack, can be placed in an improved manner on the target which is to be attacked, and consequently achieve a higher rate of target-hitting probability and an improved penetration of the target which is to be attacked, especially such as an armored vehicle. This; however, concurrently signifies, in an advantageous manner, a more economical employment of ammunition. Through the use of the inventive mine it is possible to defend a relatively wide corridor of a terrain, inasmuch as the warhead is from the very beginning; in effect, already upon its launch from the launching installation, advantageously properly aimed against the target which is to be attacked. The reliable detection of the target represents a further significant advantage.

Modifications and further advantageous features of the inventive mine are clearly ascertainable from the detailed description thereof as set forth hereinbelow. Hereby, especially the construction of the mine, whereby the distance-measurement device possesses, distributed about the circumferential direction of the mine, a number of transmitters and receivers, evidences the advantage that through the foregoing it is also possible to determine at which side of the mine there is located the target which is to be attacked; in particular such as an armored vehicle, whereupon the launching installation is aimed precisely accurately in order to be able to effectively initiate an attack against the target which is to be attacked. Hereby, the correct setting of the launching installation; in essence, the tilting and elevating procedure for the launching installation, can be effectuated through suitable power or motive elements, or through the blasting away of positioning elements.

At a modified construction, an active component can be fired from the launching installation, which besides the fuze for the active component, does not possess any own target seeking, target detection or guidance devices and, as a result thereof, can be produced extremely inexpensively. In this particular instance, it is advantageous to commence with the launching installation from an initial orientation which is approximately parallel with the ground for the setting of the firing elevation and to undertake the precise elevational adjustment for the launching installation through an upward displacement from the initial direction. In this manner, there is achieved a direct fire characteristic.

The inventive mine finds a preferable utilization as a manually positionable or installable combat engineering measure.

BRIEF DESCRIPTION OF THE DRAWINGS

Further details, features and advantages can be ascertained from the following detailed description of a generally diagrammatically illustrated embodiment of the inventive mine, taken in conjunction with the accompanying drawings in which.

DETAILED DESCRIPTION

Figure 1:
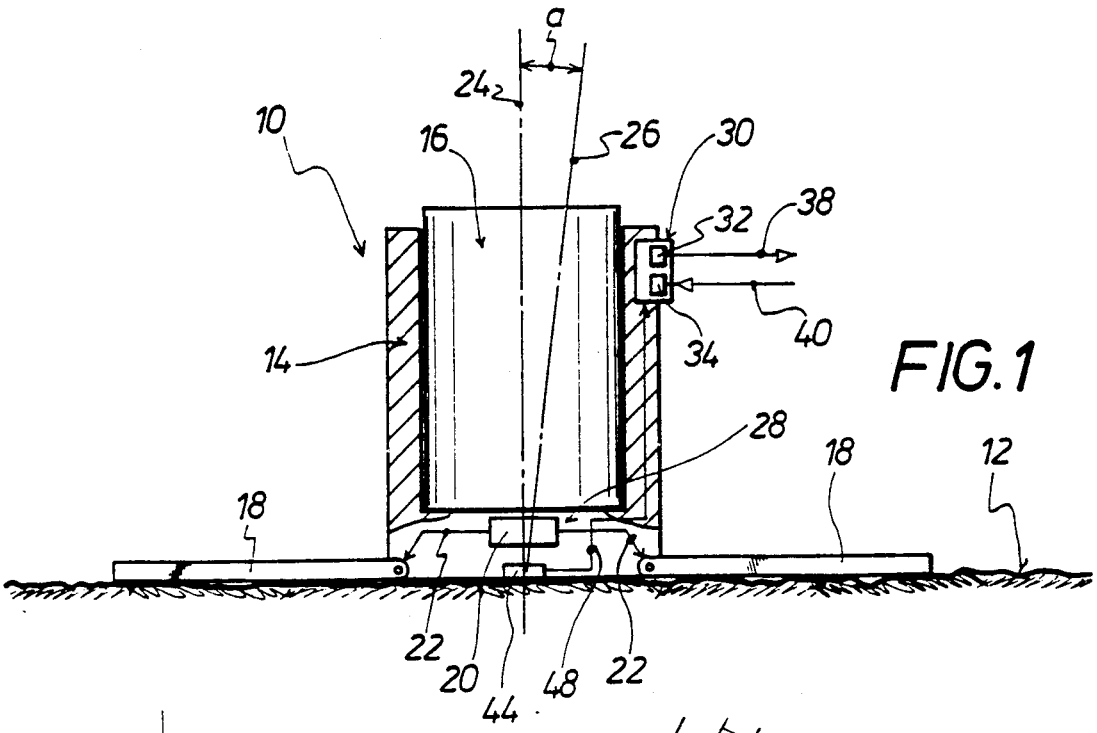
FIG. 1 illustrates a side elevational view of a schematically represented mine in the waiting or lurking position thereof, wherein the launching installation for the warhead is shown in a partially cut-away view.
Figure 2:
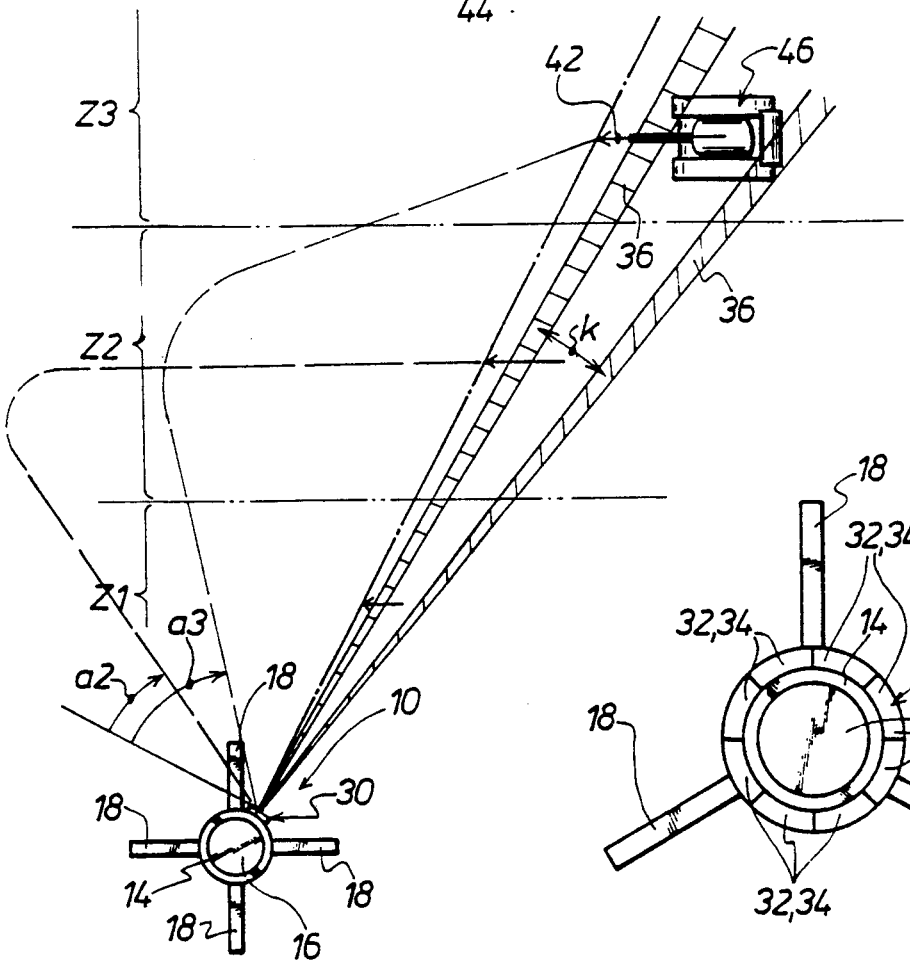
FIG. 2 illustrates a top plan view of a corridor of terrain in which a mine pursuant to FIG. 1 is arranged in a lurking position, and along which there moves, at a distance from the mine, a target which is to be attacked, especially such as an armored vehicle.

FIG. 1 illustrates a mine 10 which, for instance, pertains to an anti-tank mine, shown in the lurking position in which the mine 10 rests on the ground 12 The mine 10 possesses a launching installation 14 for a warhead 16. The launching installation 14; for example, is constructed with expanding or spreading legs 18 which are operatively connected with a drive or motive device 20. This operative connection is schematically indicated by means of the arrows 22. With the assistance of the drive device 20 it is possible; for instance, to pivot the spreading legs 18 with regard to the launching installation 14, in order to pivot the launching installation 14, for example from the vertical position, which is illustrated by a thin phantom line 24, about a specified angle 'a' such that the centerline 26 of the launching installation 14 or, respectively, that of the warhead 16, is inclined at an angle relative to the vertical 24. The drive or motive device 20 together with the expanding legs 18 accordingly forms hereby an aiming device 28 for the launching installation. In the exemplary embodiment of the mine 10, as is schematically illustrated in FIG. 1, the launching installation 14 is equipped with a range finder or distance-measurement device 30 which, as well as the drive device 20 for the expanding legs 18, is only schematically represented in the form of a block. The range finder 30 possesses at least one transmitter 32, which is represented by a block, and at least one receiver 34, also illustrated as a block, wherein each transmitter 32 and receiver 34 is preferably provided for two position-finding or directional beam columns 36, which in FIG. 1 are identified by an arrow 38 extending from the transmitter 34 and an arrow 40 which points towards the receiver 34, whereas the two directional beam columns 36 of the range finder 30 in FIG. 2 are indicated as directional beam columns possessing a small aperture angle. The two directional beam columns 36 are offset from each other by a cone angle k, as can be ascertained from FIG. 2. From the difference in time between the signals of the directional beam columns 36 it is thus possible to be able to determine the traveling speed of an armored vehicle which is to be attacked, which is indicated by the arrow 42 in FIG. 2.

In order to activate the range finder or distance-measuring device 30, the mine 10 or, in effect, its launching installation 14, is equipped with a proximity sensor 44, which is indicated as a block in FIG. 1, and which, for instance, is activatable through acoustic or seismic signals which are emitted by the target 46 which is to be attacked. The proximity sensor 44 is operatively connected with the range finder 30 for the activation of the latter, which aspect is indicated in FIG. 1 by the arrow 48.

When, with the aid of the proximity sensor 44, there is determined the approach of an enemy target 46 which is to be attacked, then, as has been previously mentioned, there is effectuated an activation of the range finder 30, with the aid of which there is then determined the direction of travel of the target 46 which is to be attacked as well as the distance of the target 46 from mine 10 and the speed of travel of the target 46, so that immediately thereafter with the aid of the aiming device 28 the launching installation 14 can be properly elevated; in essence, aimed in order to effectively strike and destroy the target 46 which is to be attacked. With the assistance of the aiming device 28, there is hereby understandably set positioning of the launching installation 14; in essence, a firing delay, in correlation with the speed of the target 26 which is to be attacked. In FIG. 2 there are indicated zones Z1, Z2 and Z3 relative to the mine 10, whereby the different terrain zones Z2 and Z3 associated therewith different angles of elevation A2, A3 and different launching time delays.

In dependence upon the kinds of information which are delivered by the range finder 30, the launching installation 14 is thus elevated or tilted more or less extensively, which is possible to implement either in increments or, at times, even in a continuous manner.

A particularly economical utilization of the inventive mine 10 is, for instance, afforded when the range finding and target speed measurement device 30 is constructed as a separate operational unit and contemplated for the operation of a number of deployed launching installations 14.

In an advantageous manner, the sensor system for introducing the target information into the launching installation 14 can assume as additional functions; for example, signature data relative to the target which is to be attacked. The target detection-sensor system of the actual ammunition can hereby be correlated with this reference information (for instance, the intensity of the signal reflection under the presently encountered weather conditions). The warhead thusly obtains prior knowledge of the particular target signature, and can then more simply detect the target which is to be attacked. In addition to the above-mentioned advantages of a comparatively wide monitored corridor, a precise placement of the warhead over the target which is to be attacked, and a more economical use of ammunition, there is obtained the further advantage in that from a number of targets which are to be attacked, especially tanks or armored vehicles, it is possible to select a specific target. Inasmuch as the launching installation 14 can be positioned already slightly elevated relative to the vertical 24 in its initial or, essentially lurking or waiting position, it is possible that in a further advantageous manner, the mine can be located especially expediently camouflaged, such as at the edge of a forest closely to trees.

Figure 3:
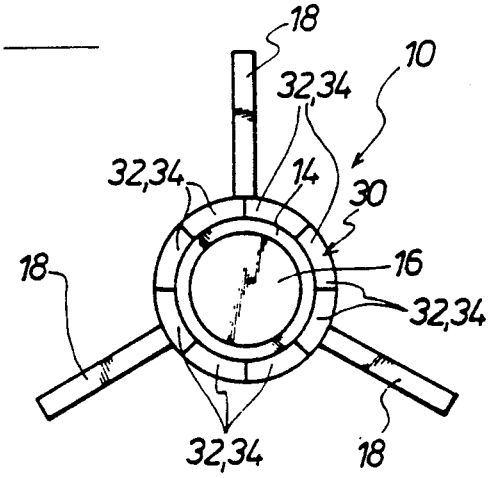
FIG. 3 illustrates a top plan view of another construction of the mine, wherein the mine; for example, can be distantly deployable in the form of articles of submunition in an artillery rocket.

FIG. 3 illustrates a mine 10 which, in particular, distinguishes itself from the mine 10 illustrated in FIG. 2 in that the range finder 30 possesses, distributed about the circumferential direction of the mine 10, a plurality of transmitters 32 and receivers 34. Through the use of such a mine 10 it is possible to determine the side from which a target which is to be attacked is approaching. With reference numeral 18 there is identified, also in this case, the supporting or, respectively, the spreading or expanding legs, by means of which the mine 10 or, respectively, its launching installation 14 with the warhead 16 is positioned in the lurking or waiting condition.

What is claimed is:

1. A mine including a warhead launching means having a warhead arranged therein and including aiming means; range-finding means positioned on said mine for determining the direction of travel and the measurement of an at least approximately horizontal distance between the mine in a lurking position thereof and a target which is to be attached, said range-finding means comprising means for determining the speed of travel of the target, said range-finding means being operatively connected with said aiming means for effectuating a setting of a specified elevation for the launching means of the warhead.

2. A mine as claimed in claim 1, wherein said range-finding means is arranged on said launching means.

3. A mine as claimed in claim 1, wherein said range-finding means is located adjacent to said launching means and is operatively connected with said launching

4. A mine as claimed in claim 1, wherein a proximity sensor is operatively connected with said range-finding means for the activation of said means.

5. A mine as claimed in claim 1, wherein said range-finding means comprises at least one transmitter and receiver for at least two directional-beam columns which are offset from each other by a specified cone angle k.

6. A mine as claimed in claim 5, wherein said range-finding means includes a plurality of said transmitters and receivers distributed about the circumference of said mine, each for respectively at least two directional beam columns and which are offset from each other by a specified cone angle k.

* * * * *

UNITED STATES PATENT AND TRADEMARK OFFICE

CERTIFICATE OF CORRECTION

PATENT NO. : 5,142,986

DATED : September 1, 1992

INVENTOR(S) : Bernd Gundel

It is certified that error appears in the above-identified patent and that said Letters Patent is hereby corrected as shown below:

Column 3, lines 64-65:

changin "Z3 associated" to --Z3 are shown to have, respectively, associated-- in col. 3, lines 64-65; and changing "A2, A3" to --a2, a3--in col. 3, lines 65-66

Column 4, line 55, Claim 1: "attached" should read as --attacked--

Column 4, line 65, Claim 3: after "launching" insert --means.--

Signed and Sealed this

Second Day of November, 1993

*Attest:*

*Attesting Officer*

BRUCE LEHMAN

*Commissioner of Patents and Trademarks*